United States Patent [19]

Sundholm et al.

[11] Patent Number: 4,944,960

[45] Date of Patent: Jul. 31, 1990

[54] METHOD AND APPARATUS FOR COATING PAPER AND THE LIKE

[76] Inventors: Patrick J. Sundholm, Smedsintie 7A, Kauniainen SF-0217700, Finland; Robert H. Donnelly, 31 MacMillan, Christchurch 2, New Zealand; Martti Y. O. Kangas, P.O. Box 2470, Decatur, Ga. 30031

[21] Appl. No.: 248,177

[22] Filed: Sep. 23, 1988

[51] Int. Cl.[5] ..... B05D 1/06; B05B 5/14

[52] U.S. Cl. ..... 427/27; 118/325; 118/326; 118/629; 118/630; 427/32; 427/424

[58] Field of Search ..... 118/629, 630, 326, 300, 118/325; 239/11, 428, 432; 427/27, 32, 424

[56] References Cited

U.S. PATENT DOCUMENTS 3,074,697 1/1963 Friedell ..... 239/428 X 4,046,074 9/1977 Hochberg et al. ..... 427/32 X 4,558,657 12/1985 Rohrbach ..... 118/326 X 4,752,496 6/1988 Fellows et al. ..... 427/391 X

*Primary Examiner*—Evan Lawrence

*Attorney, Agent, or Firm*—James B. Middleton

[57] ABSTRACT

A coating method and apparatus allows coating of a paper substrate from any point from the first de-watering stage to a fully dried stage. The method includes the making of a fog from a coating slurry, and directing the fog to a nozzle that does not physically contact the substrate. An air current normally carries the fog; but, electrostatic charges can be applied to the substrate and the fog to cause the fog to be attracted and adhere to the substrate. Vacuum chambers contiguous with the nozzle pick up excess fog and deliver the excess to a separator for recycling.

7 Claims, 1 Drawing Sheet

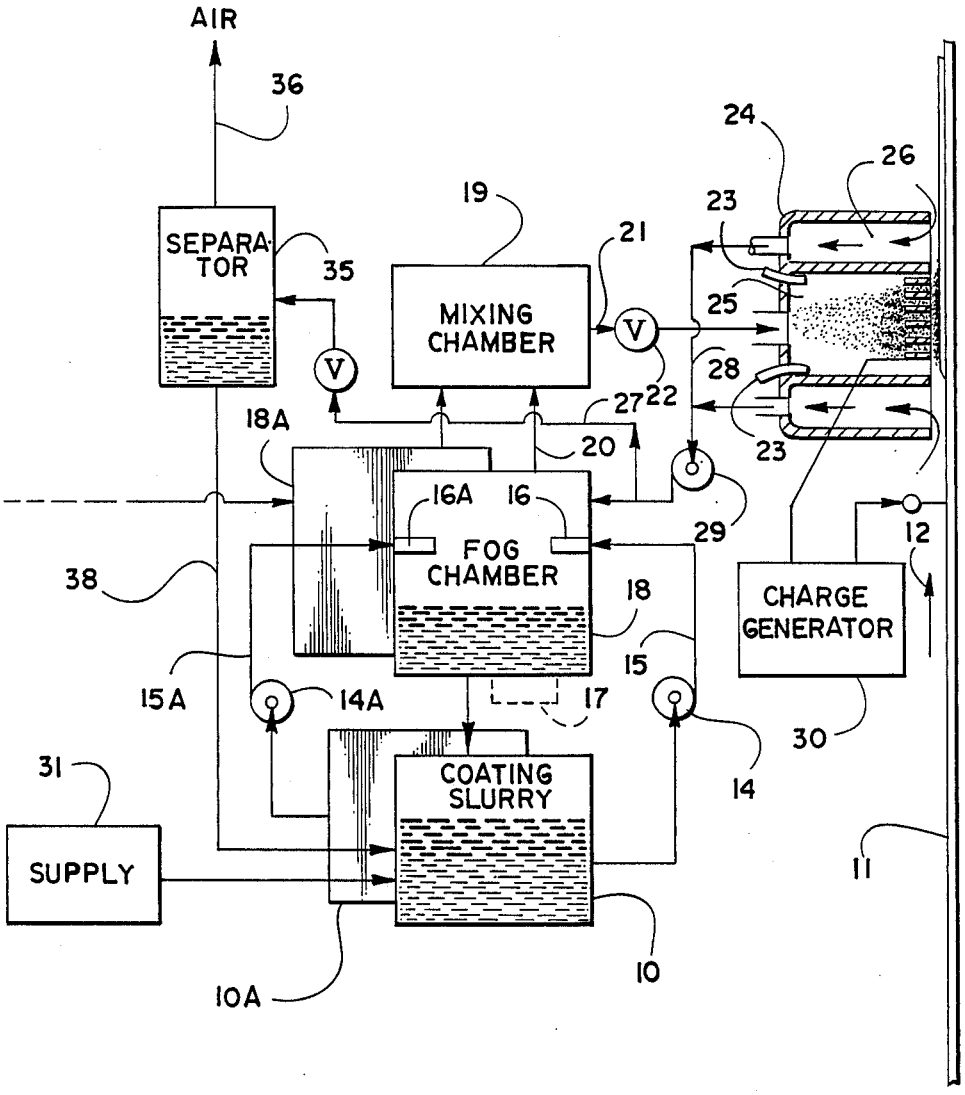
AIR
36
SEPARA-
TOR
35
V
19
MIXING
CHAMBER
21
V
22
24
26
23
25
28
23
27
20
18A
16A
16
FOG
CHAMBER
29
12
38
18
CHARGE
GENERATOR
15
15A
14A
17
30
14
31
COATING
SLURRY
SUPPLY
11
10A
10

METHOD AND APPARATUS FOR COATING PAPER AND THE LIKE

INFORMATION DISCLOSURE STATEMENT

It is well known that paper, paper board and other such materials are coated with various substances to change the color, the surface texture or the like. This coating sometimes includes a dyeing material to change the color, and often includes clay or other relatively heavy materials to fill the somewhat porous surface of a paper or paperboard to yield a smooth surface.

As is well known in the art, the manufacture of paper is a generally continuous process wherein the web has an extremely high water content, the water content being gradually reduced until the web is ultimately dried. Because of the nature of the method and apparatus for applying coatings, one is generally very limited in the selection of the stage of paper production at which the coatings are applied. Specifically, clay and the like are usually placed on the surface and scraped to the desired thickness by a roller, a doctor blade, or a similar mechanical means. This requires that the paper substrate be sufficiently strong to withstand mechanical forces as the coating is spread uniformly over the surface. There has been some effort at spraying coating materials on paper-like substrates, but the coatings have never been successfully applied using a spraying technique.

SUMMARY OF THE INVENTION

This invention relates generally to the coating of substrates, and is more particularly concerned with a method and apparatus for coating a substrate without mechanical contact with the substrate.

The present invention includes the preparation of a slurry to be used as the coating mixture, and the generation of a fog from the slurry. The fog may be mixed with fogs containing other coating materials if desired; then, the fog containing the final materials to be applied to the substrate is directed against the substrate. In the preferred embodiment, the fog and the substrate may contain static charges that assist both in contact and in retaining of the fog on the substrate, though success has been achieved without the use of the static charges.

The fog may be generated in many ways, including through the use of generally conventional spray nozzles. Another embodiment of the invention utilizes ultrasonic energy to create the fog, and perhaps by means of an ultrasonic nozzle of the type well known in the art.

Brief Description cf the Drawing

These and other features and advantages of the present invention will become apparent from consideration of the following specification when taken in conjunction with the accompanying drawing in which:

The single FIGURE is a schematic, flow diagram illustrating a method and apparatus for coating paper in accordance with the present invention.

DETAILED DESCRIPTION OF THE EMBODIMENTS

Referring now more particularly to the drawings, and to those embodiments of the invention here presented by way of illustration, it will be seen that there is a tank designated at 10 which contains a slurry to be coated on the substrate designated at 11. It will be noticed that the substrate 11 is shown extending vertically, and moving upwardly as indicated by the arrow 12. This particular orientation of the substrate 11 is by way of illustration only, and those skilled in the art will realize that the substrate may move in any direction. While it is possible that a substrate having sufficient integrity can be moved vertically, and coated while moving vertically, the substrate also may be moving generally horizontally, for example on the wire of a Fourdrinier machine.

Returning then to the tank 10, it will be seen that the slurry is removed from the tank 10 by a pump 14, the pump 14 having its discharge connected to a line 15 for feeding a nozzle 16. The nozzle 16 breaks up the slurry from the tank 10 so that the slurry becomes a spray having very small particle size, or a fog. In the present application, the material will be referred to as a fog, and it should be understood that this term includes a range of forms from a very small particle aerosol to a relatively small particle spray.

The nozzle 16 may comprise many specific pieces of hardware. It is possible that, by using a pump 14 having sufficient pressure, the nozzle 16 may in fact be a fluid type nozzle wherein the nozzle will break up a fluid that flows therethrough to produce a fine-particle spray, or a nozzle wherein gas under pressure breaks up the liquid and mixes therewith to form the fog. It is also possible to use an ultrasonic nozzle, generally of the type disclosed in the U.S. Pat. No. 4,352,459to Berger et al. Ulatrasonic nozzles are well known in the art, and those skilled in the art will understand without further explanation.

One further form that the nozzle 16 may take is a transducer located at the bottom of the tank 18. It will be noted that the tank 18 is illustrated as having some slurry in the bottom thereof, with the fog in the upper portion of the tank 18. By placing a transducer 17 at the bottom of the tank 18, ultrasonic energy can break up the slurry into fine particles to produce the desired fog above the liquid, additional fog being generated as fog is removed for use.

It will be noted that the fog from the tank 18 is directed to a mixing chamber 19, and further that there is a second tank designated at 18A, which also has its output directed to the mixing chamber 19. If desired, one might have two or more tanks such as the tanks 18 and 18A, each of the tanks 18 and 18A containing a different slurry and different fog so that two or more materials can be coated on a substrate 11 simultaneously. In the event two or more slurries and fogs are used, the plural tanks such as 18 and 18A can be utilized, the output of all being directed to the mixing chamber 19 where the fogs are intermixed to the point of substantial homogeniety. In the event only one tank such as the tank 18 is to be used, the mixing chamber 19 may be omitted, and the output 20 from the tank 18 can be connected directly to the output 21 of the mixing chamber 19.

Another means for providing two different materials for coating the substrate 11 is to provide two or more of the tanks such as the tank 10. In the drawings, a second tank 10A is shown, and a pump 14A moves the material from the tank 10A and feeds the material through a line 15A to a nozzle 16A in the tank 18. It will therefore be understood that two different fogs are generated within the tank 18 by the nozzles 16 and 16A. The mixed fogs will then be directed to the mixing chamber 19, or directly to the application nozzle 24.

From the mixing chamber 19, the output at 21 is directed through a valve 22, then to the application nozzle generally indicated at 24. Those skilled in the art will be aware that a valve arrangement is commonly used in adjusting pressure across the web of paper, such valve arrangements being computer controlled in a plurality of sections to equalize the pressure across the web. The valve 22 here illustrated is expected to take the form of that prior art arrangement, the object being to adjust the volume of material directed to the substrate 11.

The present invention also provides injection means 23 for injecting air or other gas into the stream of fog. The injection means 23 are shown to be located adjacent to the walls of the application nozzle 24, and in this position a curtain of gas is placed along the walls to prevent the attachment of droplets on the walls.

The injection means 23, however, can replace the valve 22. A plurality of gas injectors 23 can be placed across the nozzle, or a conduit leading to the nozzle. These gas injectors can be computer controlled as with the prior art valve 22; but, the quantity of material will be varied by injecting gas to dilute the material. It will also be understood that the gas injectors 23 can be used alone, or in conjunction with a conventional valve such as the valve 22. The curtain can prevent formation of droplets on the walls, while the valve 22 can be used as the control.

In looking at the application nozzle 24, it should be understood that the fog is carried to the application nozzle 24 by the air flow produced by a fan, or centrifugal blower, 29. The output of the blower 29 is directed to the tank 18 which contains a supply of fog. A current is therefore established through the line 21 and through the valve 22, then to the application nozzle 24 and onto the substrate 11. The nozzle 24 includes a central application area 25 which receives the fog and directs the fog towards the substrate 11, and the fog will tend to move in a straight line and engage the substrate 11.

In the event some of the fog fails to engage the substrate 11 and/or fails to adhere thereto, the nozzle 24 includes a return chamber 26. The chamber 26 is connected through the line 28 to the suction side of the blower 29 so the return chamber 26 is at a lower pressure and will somewhat scavenge the area of the application nozzle 24. Also of course, the return chamber 26 acts as the intake for the blower 29. Fluid therefore flows through the line 28, through the blower 29, through the tank 18, thence through the line 20, the chamber 19, and the line 21. The valve 22 will adjust the flow and allow the desired fog to enter the application chamber 25 of the nozzle 24.

Since the flow to the application nozzle 24 may be varied, it is desirable to utilize a variable speed blower 29 in an effort to match the flow through the blower 29 to the flow to the nozzle 24. Even so, there may be times when there is excess volume at the high pressure side of the blower 29; therefore, a bleed line 27 will allow the excess to be directed to a separator 35.

To assist in causing the fog to attach to the substrate 11, it is contemplated that a static electric charge will be utilized on the fog and on the substrate 11. Those skilled in the art will readily understand that the substrate 11 can be charged, and that the fog can be charged by means of a grating or the like. For purposes of illustration, a charge generator is indicated at 30, there being only one charge generator shown. Nevertheless, it will be understood that one charge (e.g. a negative) can be generated and placed on the substrate 11 while the opposite charge (e.g. a positive) can be placed on the fog. These opposite charges will cause the fog to be attracted to the substrate 11 and stick thereto.

An important feature of the present invention is the application of the fog-containing coating material to a substrate 11 at low pressure and without mechanical manipulation or the like. This allows the system of the present invention to be utilized for coating paper anywhere along the paper production line, from the first de-watering stage until the paper has been completely dried. If desired, the paper can be manufactured and rolled up, and the rolls can be transported to another location, unrolled and then coated using the system of the present invention.

Returning briefly to the drawing, it will be seen that there is a supply of material designated at 31. This supply of material can be a larger tank, mixing means or the like to supply the coating slurry in the tank 10. Those skilled in the art will understand that any means for providing the slurry in the tank 10 is a reasonable equivalent of the supply 31 shown.

Looking again at the separator 35, the separator 35 may include any conventional filter or the like, the object of the separator 35 being to separate the gas from the liquid portion of the excess fog from the blower 29. When the gas and liquid are separated, the gas is simply discharged to atmosphere at 36, and the liquid is returned through the line 38 to the tank 10 for reuse. If it is determined that the gases discharged at 36 contain improper contaminants, some further removal of material may be necessary before the gas is discharged to the atmosphere.

It will therefore be seen that the present invention provides an extremely simple method and apparatus for coating substrates. Since the slurry to be coated on the substrate is transformed into a fog, and the fog is applied at very low pressure, it will be understood that the substrate will never be harmed, even when the substrate is largely water. The use of the electrostatic charge will assure appropriate coating of the substrate and adherence thereto until the substrate is completely dried. Further, in view of the coating technique, it will be understood that any conventional drying technique is appropriate so that infrared lamps or the like can be utilized to dry the coating on paper or board.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

We claim:

1. A method for coating a paper-like substrate wherein said substrate moves continuously along a path, said method including the steps of providing a plurality of slurries, each slurry of said plurality of slurries comprising a material to be coated on said substrate, breaking up each of said slurries into small particles for producing a plurality of fogs containing said material to be coated on said substrate, mixing said plurality of fogs and directing the resulting mixture towards said substrate for adherence to said substrate, wherein the said step of directing the resulting mixture towards said substrate includes the steps of placing an application nozzle adjacent to said substrate, and providing a positive force for urging said mixture through said application nozzle and towards said substrate.

2. Paper coating apparatus for coating a continuously moving substrate, said apparatus including at least one means for providing a slurry containing solid material to be coated onto said substrate, means for breaking up said slurry into fine particles for creating a fog containing said solid material to be coated onto said substrate, application means for applying said fog to said substrate, said application means being adjacent to and spaced from said substrate and spaced from said means for breaking up said slurry and means for providing a current of gas for entraining said fog and carrying said fog through said application means.

3. Paper coating apparatus as claimed in claim 2, said means for breaking up said slurry including at least one fog chamber, and nozzle means in said fog chamber for breaking up said slurry.

4. Paper coating apparatus as claimed in claim 3, said application means comprising an application nozzle having an application area, and further including a vacuum chamber adjacent to said application area for picking up excess fog in the vicinity of said substrate.

5. Paper coating apparatus as claimed in claim 4, and further including charge generating means for generating electrostatic charges, means for placing one electrostatic charge on said substrate, and means for placing the opposite electrostatic charge on said fog when said fog is in said application nozzle.

6. Paper coating apparatus as claimed in claim 5, and further including means for controlling the quantity of fog directed to said application means.

7. Paper coating apparatus as claimed in claim 6, and including a plurality of said fog chambers, and a plurality of said means for providing a slurry containing the solid material to be coated, the arrangement being such that a fog can be created from each of a plurality of materials to be coated onto said substrate, and further including a mixing chamber for receiving a plurality of fogs for mixing the fogs and directing the mixture to said application nozzle.

* * * * *